United States Patent [19]

Landa

[11] 4,418,903

[45] Dec. 6, 1983

[54] LARGE CAPACITY COMBINATION MAGAZINE AND SHEET FEEDER FOR COPYING MACHINES

[75] Inventor: Benzion Landa, Edmonton, Canada

[73] Assignee: Savin Corporation, Valhalla, N.Y.

[21] Appl. No.: 336,033

[22] Filed: Dec. 31, 1981

Related U.S. Application Data

[60] Continuation of Ser. No. 110,924, Jan. 10, 1980, abandoned, which is a division of Ser. No. 898,139, Apr. 20, 1978, abandoned, which is a continuation of Ser. No. 269,774, Jun. 3, 1981, Pat. No. 4,362,297.

[51] Int. Cl.[3] ..... B65H 5/00

[52] U.S. Cl. ..... 271/10; 271/22; 271/126; 271/162

[58] Field of Search ..... 271/10, 113, 114, 116, 271/126, 109, 9, 21, 22, 162, 164

[56] References Cited

U.S. PATENT DOCUMENTS

| | | | |
|---|---|---|---|
| 1,582,897 | 5/1926 | Blaine | 271/152 |
| 2,108,628 | 2/1938 | Von Hofe et al. | 271/153 |
| 3,881,717 | 5/1975 | Dean | 271/9 X |
| 3,920,238 | 11/1975 | Kitajima | 271/114 X |
| 3,966,189 | 6/1976 | Taylor | 271/34 |

FOREIGN PATENT DOCUMENTS

| | | | |
|---|---|---|---|
| 1966526 | 1/1973 | Fed. Rep. of Germany | 271/162 |
| 719954 | 12/1954 | United Kingdom . | |
| 1045208 | 10/1966 | United Kingdom | 271/152 |

*Primary Examiner*—Richard A. Schacher
*Attorney, Agent, or Firm*—Shenier & O'Connor

[57] ABSTRACT

My invention comprises a large capacity combined magazine and sheet feeder for copying machines, in which the sheet being fed is brought to feeding level by a spring-powered mechanical servomechanism. The assembly is adapted to be substituted for a small capacity cassette on an existing copy machine and to employ the power and logic of the existing machine to feed sheets from the large capacity assembly in proper synchronzied relationship. This is accomplished by a power take-off from the copy machine with which the improved magazine is beng used, which power take-off can be installed without altering the original machine. The large capacity unit then feeds sheets to the copy machine as if the original small capacity cassette were being used. The magazine is adapted to handle sheets of various lengths on which copies are to be made. The action of the lifting springs is damped by an inertial damper which controls the rate of upward movement of the paper supporting platform which is constrained to move parallel to itself by a parallel motion linkage.

3 Claims, 10 Drawing Figures

Fig 1
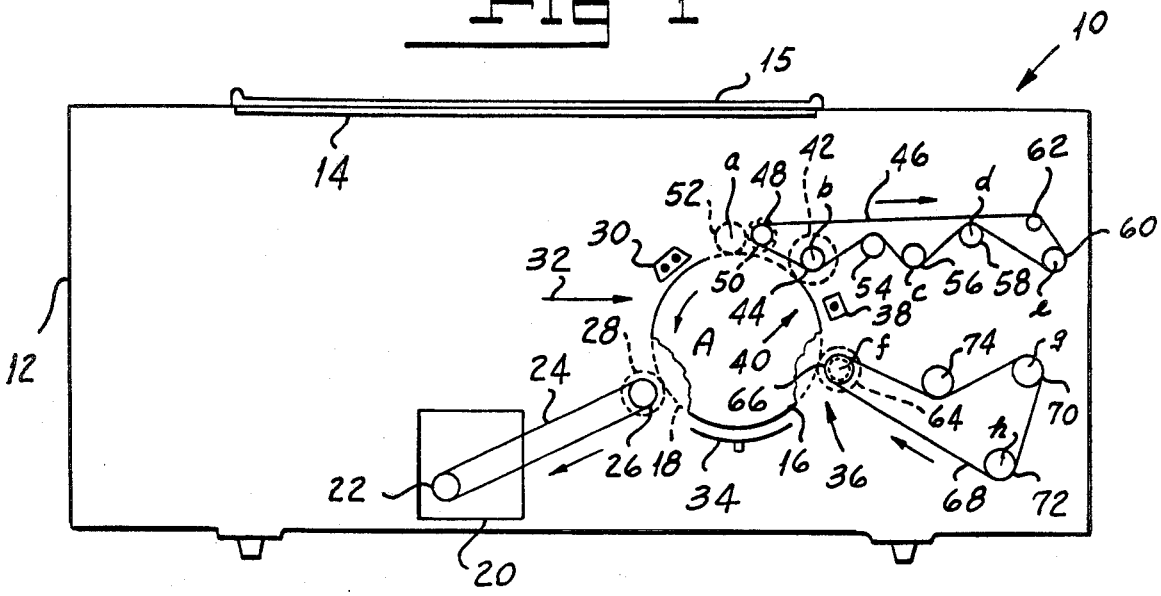
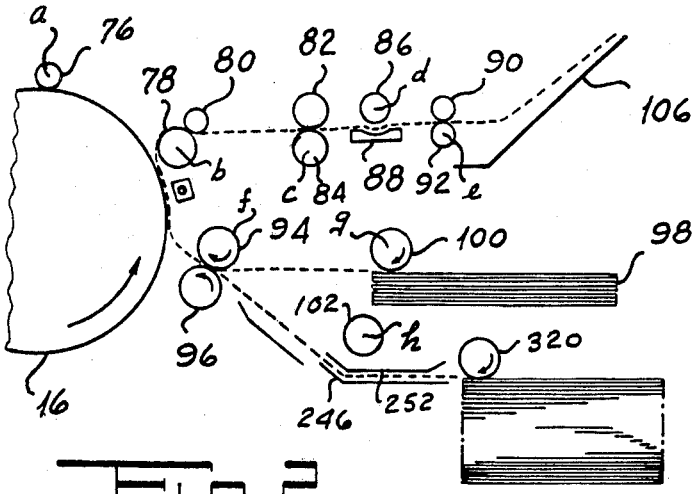
Fig 2
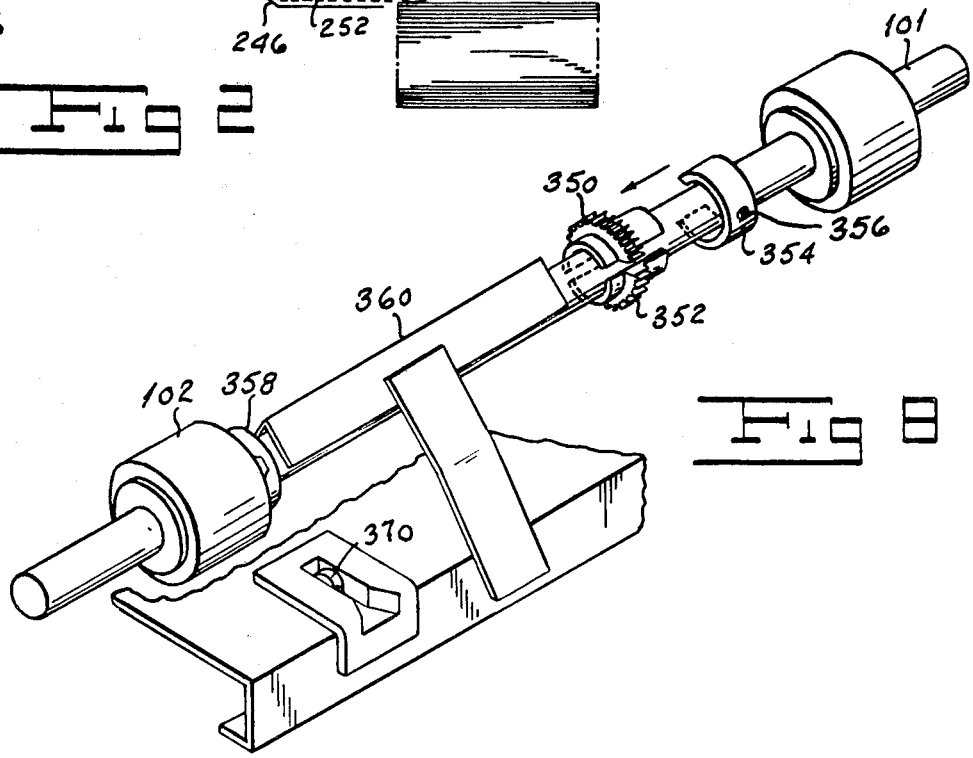
Fig 8

Fig 5
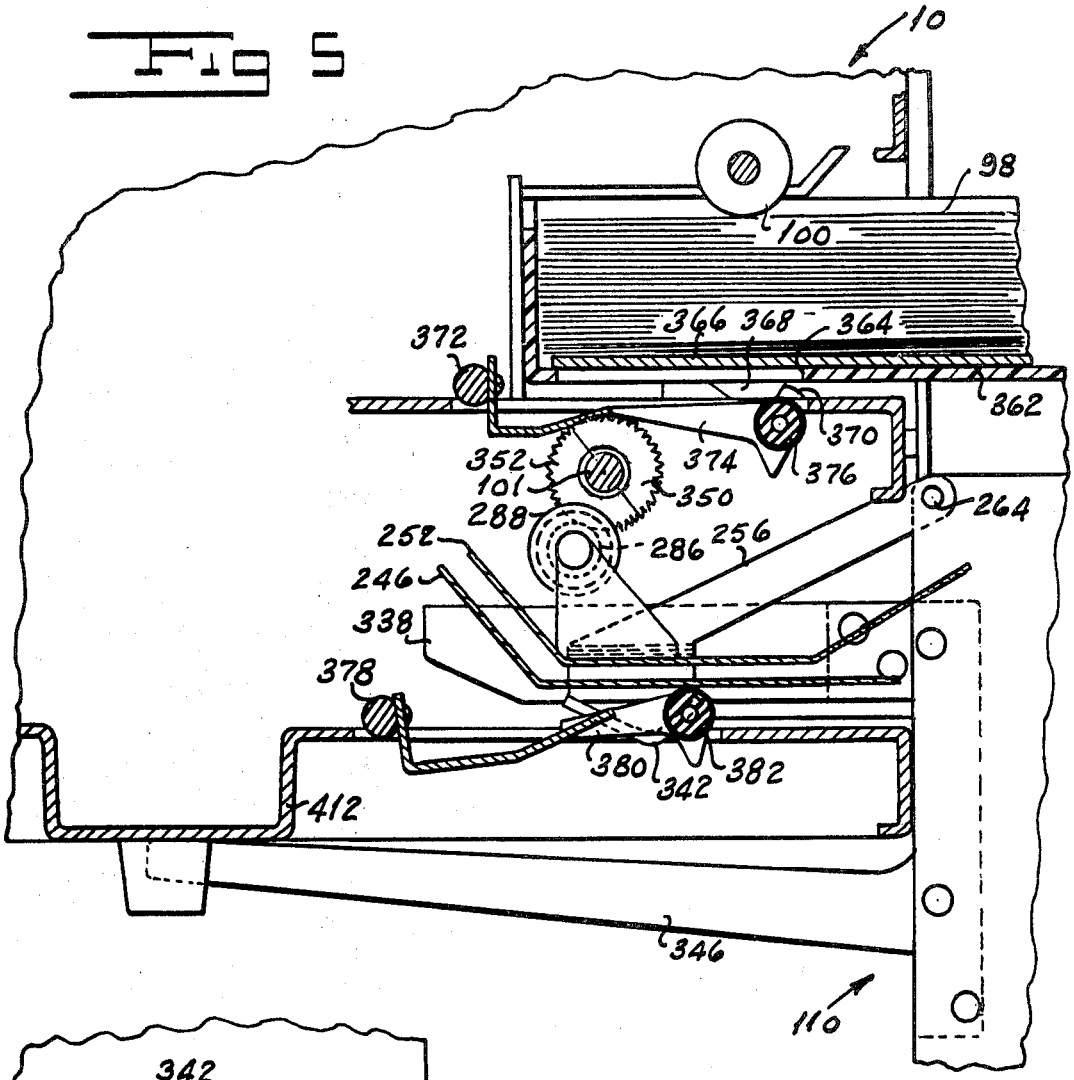
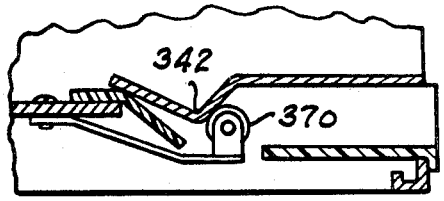
Fig 7
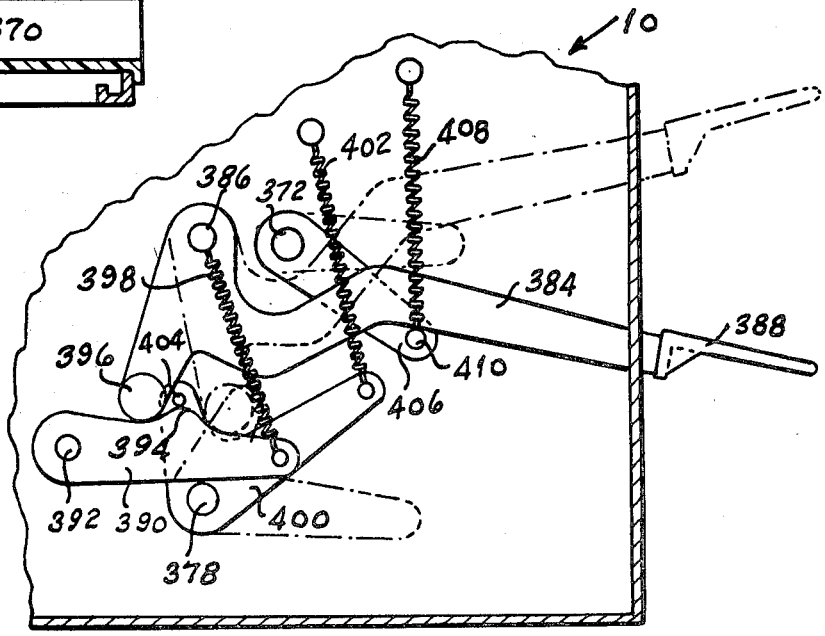
Fig 6

LARGE CAPACITY COMBINATION MAGAZINE AND SHEET FEEDER FOR COPYING MACHINES

This is a continuation of application Ser. No. 110,924, filed Jan. 10, 1980, now abandoned, which was a division of application Ser. No. 898,139, filed Apr. 20, 1978 now abandoned, of which a continuation application Ser. No. 269,774, filed June 3, 1981, issued as U.S. Pat. No. 4,362,297 on Dec. 7, 1982.

BACKGROUND OF THE INVENTION

The prior art shows electrostatic copying machines of the developed image transfer type in which the surface of a photoconductor is successively moved past a charging station at which the surface receives a uniform electrostatic charge, past an exposure station at which the charged surface is exposed to a light image of the original to be copied to form an electrostatic image, past a developing station at which the electrostatic image is developed by particles of toner, past a transfer station at which the developed image is transferred to a sheet material, such as plain paper, and then to a pickoff station at which the sheet carrying the developed image is removed from the surface of the photoconductor and delivered by rollers to a delivery tray. In such machines, it is desirable that the user be able selectively to make a copy of a shorter document on a shorter length paper or a copy of a longer document on a longer length paper. A machine incorporating this capability is disclosed in Suzuki et al U.S. Pat. No. 3,977,666, for "Apparatus for Selectively Feeding Sheets from a Plurality of Cassettes".

While the Suzuki et al patent has the capability of selectively feeding sheets of different lengths from respective cassettes to a pair of synchronizing rolls, both of the cassettes have the same limited capacity. In a practical embodiment of the apparatus disclosed in the Suzuki et al patent, each cassette has a capacity of approximately 250 sheets. In the operative condition of each of the cassettes shown in the Suzuki et al patent, a spring biased member acting through an opening in the bottom of the cassette engages the forward portion of the sheet supporting plate to tilt the stack so as to bring a leading portion of the uppermost sheet into engagement with the feed roller of the machine. The principal defect of cassettes of the type shown in the Suzuki et al patent is their limited capacity. It is to be noted first that the capacity of one or both of the cassettes shown by Suzuki et al could not be increased merely by increasing the size of the cassette. The problem is to urge the stack of sheets so as to move the uppermost sheet against a pair of rollers with a substantially constant pressure or to move the stack so that the uppermost sheet is at a constant level with the rollers applying a constant pressure. In the system shown in Suzuki et al where only 250 sheets make up the stack, which is raised only a given fraction of the sheet length, one can use a linear spring to load the paper and as the paper is consumed the actual interface pressure between the top sheet and the rollers is more or less constant. This is because only part of the length of the stack is being raised so that the length of the sheets is not of major significance when only 250 sheets are involved. That is to say, the leading edge of the uppermost sheet is not displaced appreciably relative to the feed roll as the stack is depleted.

When one considers a large capacity magazine, such for example one holding 1000 sheets, it will readily be apparent that for geometric reasons it is not possible to provide an arrangement in which only the leading portion of the stack is moved upwardly against the rollers, owing to the fact that by the time the last sheet in the stack is reached, the slope of the paper will be so great as to produce a displacement of approximately one and one-half inches of its length relative to the position of the feeding rollers.

If as an alternative to raising the front of the stack an arrangement is considered in which the entire stack is raised for letter-size sheets, a weight of about four and one-half kilograms is involved, while for legal-size sheets about six kilograms must be raised. The difference of one and one-half kilograms between the letter and legal sizes means, if one employed a spring mechanism to raise the stack of paper which was the same for both letter and legal lengths of paper, a constant spring pressure independently of the number of sheets remaining in the stack and independently of the length of the sheets would be necessary. Such an arrangement is unfeasible. Thus there is a one and one-half kilogram discrepancy between the legal and letter paper sizes, together with the requirement, which I have found, of maintaining relatively constant pressure between the feed roller and the uppermost sheet of 300 grams, plus or minus 50 grams, before the mechanism will function properly. Faced with this problem, it has been suggested in the prior art that an electrical servomechanism be employed which will raise the stack of sheets to a constant level. More specifically, it has been proposed that a micro-switch be positioned to detect the level to energize a motor to actuate a lifting device when the paper drops down to below the predetermined level. In such an arrangement, the rollers themselves would be arranged to exert a certain pressure on the top of the sheet.

While the arrangement just described might operate satisfactorily, it incorporates a number of defects. It requires an electrical connection to the copier with which it is used. It is relatively expensive to construct and to operate. It is not readily adapted for use with existing machines.

While it is desirable that a user be able to make a copy of a short document on a relatively short sheet of paper or, alternatively, to make a copy of a relatively long original on a correspondingly long sheet of material, most users make a great many more copies of one length original than of another length. For example, in the usual commercial office, it is likely that many more copies of "letter" size documents be made than of "legal" size documents. On the other hand, in an office offering legal services, it is probable that a great many more "legal" size documents will be copied. It is thus desirable that the large capacity magazine have the capability of feeding sheets of both sizes. My large capacity magazine is able to be used with existing machines of the type shown in the Suzuki et al patent, as well as with an original machine.

I accomplish all of the above-outlined advantageous results without requiring an electrical connection to the existing machine. My large capacity cassette is relatively easily loaded without danger to the operator, which might occur if the paper supporting means is not properly controlled.

SUMMARY OF THE INVENTION

One object of my invention is to provide a large capacity combination magazine and sheet feeder which is interchangeable with cassettes on copy machines of the prior art.

Another object of my invention is to provide a large capacity combination magazine and sheet feeder for a photocopy machine which receives all of its logic and power from a paper feed shaft of the copy-making machine.

Yet another object of my invention is to provide a large capacity combination magazine and sheet feeder which requires no external energy source for maintaining the correct height of the uppermost sheet in the stack of sheets.

Still another object of my invention is to provide a large capacity combination magazine and sheet feeder in which the level of the uppermost sheet in the stack is controlled by the paper feed roller of my assembly.

A further object of my invention is to provide a large capacity combination magazine and sheet feeder which can be loaded without danger to the operator.

A still further object of my invention is to provide a large capacity combination magazine and sheet feeder which is relatively inexpensive to construct.

A further object of my invention is to provide a large capacity combination magazine and sheet feeder which is simple and certain in operation.

Other and further objects of my invention will be apparent from the following description.

BRIEF DESCRIPTION OF THE DRAWINGS

In the accompanying drawings, which form part of the instant application and which are to be read in conjunction therewith, and in which like reference numerals are used to indicate like parts in the various views:

FIG. 1 is a schematic view of the drive system of one form of copying machine with which my large capacity combination magazine and sheet feeder may be used.

FIG. 2 is a schematic view illustrating the paper feed paths for the copying machine of FIG. 1 when provided with my large capacity combination magazine and sheet feeder.

FIG. 6 is a fragmentary sectional view of a copying machine with which my large capacity combination magazine and sheet feeder may be used illustrating the manner of selectively feeding from my large capacity combination magazine and sheet feeder or from a relatively low capacity cassette.

FIG. 7 is a fragmentary sectional view illustrating the manner in which my large capacity combination magazine and sheet feeder is positioned on the copying machine.

FIG. 8 is an exploded view illustrating the manner in which an existing machine is adapted for use with my large capacity combination magazine and sheet feeder.

FIG. 9 is a side elevation of another embodiment of my invention with parts removed and parts broken away.

DESCRIPTION OF THE PREFERRED EMBODIMENT

Figure 3:
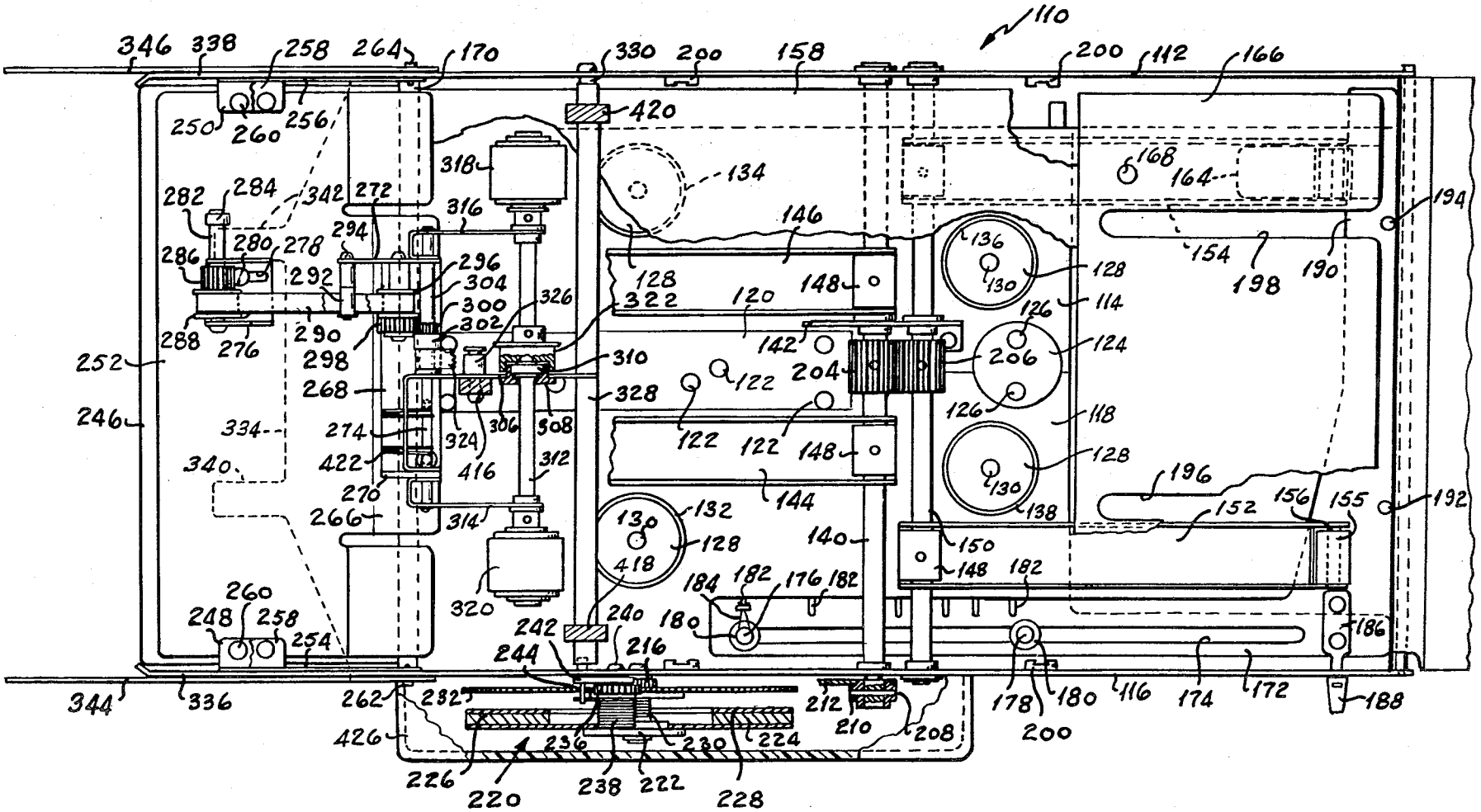
FIG. 3 is a top plan of my large capacity combination magazine and sheet feeder with parts broken away with other parts removed and with parts shown in section.

Referring now to FIGS. 1 and 2 of the drawings, a copy machine indicated generally by the reference character 10 with which my large capacity combination magazine and sheet feeder may be used includes a cabinet 12, the top of which is provided with a transparent platen 14 which is normally covered by a cover 15 connected by a hinge (not shown) to the cabinet. The cover may be moved away from the platen to permit an original to be placed face down thereon. A drum 16 carrying a suitable photoconductor on its surface is supported for rotary movement in the cabinet 12. In the schematic view in FIG. 1, for purposes of simplicity, I have illustrated gears in broken lines and have indicated sprocket wheels in full lines. A gear 18 which rotates with the drum 16 is adapted to be driven to move the drum in the direction of the arrow A. Machine 10 includes a prime mover 20, the output shaft of which carriers a sprocket wheel 22, which drives a pitch chain 24 to rotate a sprocket wheel 26. Chain 24 moves in the direction of the arrow adjacent to the chain so that a gear 28 mounted on the shaft of sprocket wheel 26 drives gear 18 to rotate the drum 16 in the direction of the arrow A.

As is known in the art, as the drum 16 rotates, its surface moves past a corona 30 which is activated to produce a uniform electrostatic charge on the surface of the photoconductor carried by the drum. After leaving the corona 30, the charged surface passes an exposure station indicated by the arrow 32, at which a pattern of light and shade representing the image of the original is projected onto the surface of the moving drum 16 to form an electrostatic image thereon. Since the details of the optical system per se are known to the prior art and form no part of my invention, they have not been shown in the drawings.

After leaving the exposure station 32, the photoconductor bearing the latent electrostatic image on the surface of the drum moves through a developer unit 34, at which the latent electrostatic image is subjected to the action of a liquid developer containing dispersed particles of toner which adhere during development to those areas of the drum surface which retain their charge after exposure to the light image of the original which is being copied. As the developed image moves farther in the direction of the arrow A, a sheet of material such as plain paper is fed to the drum at a location indicated generally by the reference character 36. The fed paper then moves with the drum past a transfer corona 38 which is energized to cause the developed image to transfer from the photoconductive surface on the drum to the paper in contact with the photoconductor. After transfer, the sheet is picked off from the drum at a station indicated generally by the reference character 40.

A gear 42 which meshes with the drum gear 18 provides the power input to the copy pickoff and delivery system. Gear 42 is mounted on a shaft which is common to a sprocket wheel 44, so that the gear and sprocket wheel rotate together around an axis "b". Sprocket wheel 44 drives pitch chain 46 in the direction of the arrow adjacent to the chain in FIG. 1. Chain 46 drives a sprocket wheel 48, the shaft of which carries a gear 50 which meshes with a gear 52 to drive it in a counterclockwise direction around the axis "a" of the cleaning roll to be described hereinbelow.

Chain 46 also engages a tensioning sprocket wheel 54 and a sprocket wheel 56 mounted for rotation around the axis "c" of the lower of a pair of takeoff rollers to be described hereinbelow. A hold-down roller sprocket wheel 58 is driven by chain 46 in a counterclockwise direction around an axis "d". Finally, the pitch chain 46 drives a lower delivery roller sprocket wheel 60 mounted for movement around an axis "e". An idler sprocket wheel 62 completes the path of the chain back to the sprocket wheel 48.

The drive system for the copy paper supply assembly includes a gear 64 adapted to be driven by the drum gear 18. A sprocket wheel 66 on a shaft common to the gear 64 is driven around an axis "f" to drive a pitch chain 68 in the direction of the arrow adjacent to the chain in FIG. 1. Chain 68 drives respective upper and lower paper supply roller sprocket wheels 70 and 72 for movement around respective axes "g" and "h". A tensioning sprocket wheel 74 tensions the chain 68. All of the gear sprocket wheel and pitch chain mechanism thus far described is located at the rear of the machine 10.

Referring to FIG. 2, a cleaning roller 76 is mounted for movement around the axis "a", so as to be driven by the gear 52, to move the surface of the cleaning roller in engagement with the drum in the direction opposite to the direction movement of the drum surface.

A take-off roller 78 cooperates with a roller 80 to deliver a picked-off sheet to the nip between a pair of intermediate conveyer rollers 82 and 84, the roller 84 of which is mounted for movement around the axis "c". After leaving the rollers 82 and 84, the sheet passes between a hold-down roller 86 mounted for movement around the axis "d", so as to be brought into operative relationship with a dryer 88. As the sheet leaves the dryer 88, it enters the nip between delivery rollers 90 and 92, the lower roller 92 of which is mounted for movement around the axis "e". These rollers pass the copy to a delivery tray 106.

The machine with which my large capacity combination magazine and sheet feeder is used includes a first relatively lower capacity cassette of the type shown in the Suzuki et al patent, which holds a supply 98 of sheets of paper of the relatively less frequently used length. Associated with the supply 98 is a feed roller 100 supported for movement around the axis "g". The machine includes a second feed roller 102 mounted for movement around the axis "h" with which my large capacity combination magazine and sheet feeder is associated. It will readily be appreciated that each of the feed rollers 100 and 102 is driven on each operation of the machine. However, as will be explained more fully hereinbelow, only one of the two rollers 100 and 102 is brought into operative relationship with its associated paper supply during any one operation of the machine.

Figure 4:
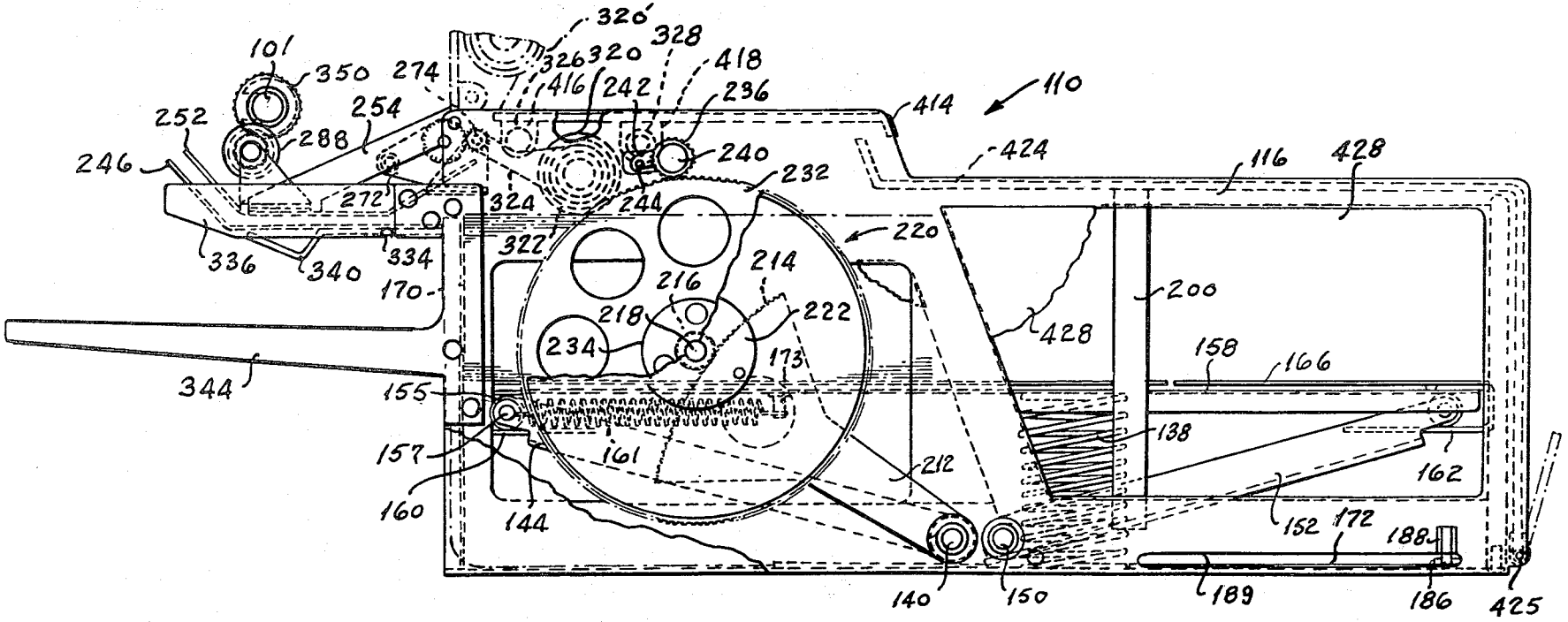
FIG. 4 is a side elevation of the form of my large capacity combination magazine and sheet feeder illustrated in FIG. 3, with parts broken away and with other parts removed for purposes of clarity.

Referring now to FIGS. 3 and 4, my large capacity magazine and sheet feeder, indicated generally by the reference character 110, includes a side wall 112 having a base portion 114 and an opposite side wall 116 having a base portion 118 adapted to abut the base portion 114 along the longitudinal center line of the assembly. A center line base connecting plate 120 is secured to each of the base portions 114 and 118 by means of bolts, rivets, or the like 122. A circular plate 124 to the right of plate 120 as viewed in FIG. 3 is secured to the two base portions 114 and 118 by means of bolts or the like 126.

I secure four feeder spring locating disks 128 to the base portions 114 and 118 at selected locations thereon by any suitable means, such as bolts or rivets 130. The four locating disks 128 receive the lower ends of four respective helical feed springs 132, 134, 136, and 138. The springs are designed to lift the stack of paper in the magazine.

My feeder includes a left-hand guide arm shaft 140 which passes through the upright portion of a bracket 142 secured to the base portion 114. The ends of shaft 140 are supported in suitable bearings in the side wall frames 112 and 116. A pair of spaced left-hand guide arms 144 and 146 are carried by respective bushings 148 secured to shaft 140 for rotation therewith.

Respective bearings in the side wall 112 and in the side wall 116 support the right-hand guide arm shaft 150, which also passes through a bearing on the bracket 142. Respective paper guide arm bushings 148 secured to shaft 150 for rotation therewith carry respective right-hand guide arms 152 and 154. Respective pivot pins 156 at the ends of arms 152 and 154 remote from shaft 150 rotatably support guide rollers 155. Referring to FIG. 4, a common left-hand guide arm roller pivot pin 157 at the ends of arms 144 and 146 remote from shaft 140 supports a pair of respective guide arm rollers 155 associated with arms 144 and 146. The main paper support plate 158 of my assembly is formed with a pair of left-hand guide arm roller coupling brackets or channels 160, one of which is shown in FIG. 4 for receiving the left-hand guide arm rollers 155. Similarly, respective right-hand guide roller coupling brackets 162 and 164 are formed at the right-hand end of paper supporting plate 158 and receive the rollers 155 of the respective right-hand guide arms 152 and 154. Rivets 168 (shown in FIG. 3), or the like, secure an auxiliary paper support plate 166 to the plate 158. It will be readily appreciated that the guide-arm, guide-arm roller, meshing gears 204 and 206, and paper-support bracket assembly just described forms a parallel motion linkage which serves to constrain the paper support plate 158 to move parallel to itself in its upward and downward motion. This prevents the paper stack being supported in my magazine from canting and producing a paper jam or a skip in the feeding of sheets from the top of the stack to the copy machine.

I employ any suitable means to secure a front paper guide plate 170 to the assembly of the side walls 112 and 116 and base portions 114 and 118. A support plate positioning spring 161 extends between the common left-hand guide roller shaft 157 and a post 173 secured to the underside of plate 158. This spring removes forward and rearward lost motion from the paper support plate and maintains the paper support at the front of the magazine assembly against the front wall of the assembly or against appropriate vertical guides (not shown). A plurality of feed spring locating disks 128 secured to the underside of plate 158 at locations corresponding to the locations of the disks 128 on the base portions 114 and 118 receive the upper ends of the drive springs 132, 134, 136, and 138.

Figure 10:
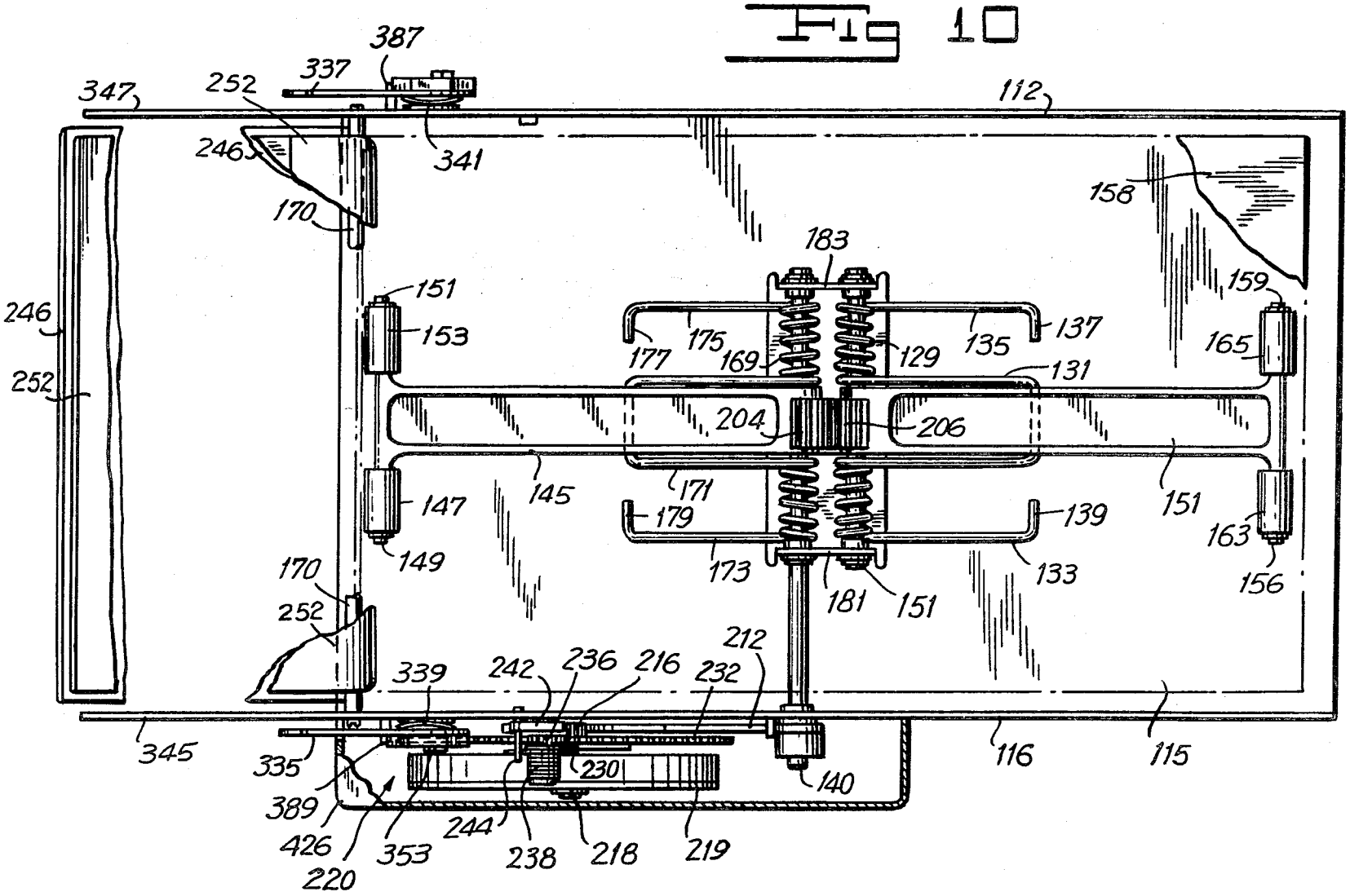
FIG. 10 is a top plan view of the embodiment shown in FIG. 9, with the paper stack supporting platform removed, to show another form of biasing means for lifting the paper supporting platform.

Referring now to FIGS. 9 and 10, I have shown a magazine assembly embodying my invention in which I employ "mousetrap" type springs instead of helical springs. Furthermore, I use only two guide arms 145 and 151 for supporting four guide arm rollers 147, 153, 163, and 165. The shaft 140 passes through a torsion spring coil 169 which is formed in two connected sections separated by a U-shaped extension 171, as can readily be seen by reference to FIG. 10. This extension bears against the underside of guide arm 145 to bias its end upwardly. Guide arm 145 carries a shaft 149 at its outer end to form a T with the guide arm. The shaft 149 rotatably supports one pair of guide arm rollers 147 and 153. One outer end of spring 169 is formed with an extension 175 and a leg 177 which bears against the bottom 115 of the magazine housing. Similarly, the other outer end of torsion spring 169 is formed with an extension 173 and a leg 179 which bears against the bottom of the housing. The shaft 140 passes through supporting brackets 181 and 183, shown in FIG. 10. A shaft 151, analagous to shaft 150 of FIG. 4, is supported by the brackets 181 and 183. A torsion spring 129, similar to spring 169, is positioned around shaft 151. This spring is likewise formed with a central U-shaped portion 131 and two end extensions 135 and 133 which are provided with respective legs 137 and 139. These legs bear against the bottom of the housing. The U-shaped extension 131 bears against the bottom of guide arm 151 to bias its end upwardly. The torsion springs are shown in FIG. 9 in their wound position. When free, the U-shaped extension and the end extensions of the front spring 169 will make an angle of about 50° with each other. The rear spring U-shaped extension 131 and the end extensions 133 and 135 of the rear spring 129 will make an angle of about 45° with each other. This difference arises owing to the fact that, in the embodiment of FIGS. 9 and 10, the gears 204 and 206 are so meshed as to tilt the paper support plate 158 with its front end about one-half inch higher than its rear end. This requires the front torsion spring to thrust through a longer amplitude. The forward and rearward inclination of the paper support plate can readily be seen in FIG. 9. This tilt, that is, the elevation of the front end of the paper support plate with respect to its rear end, serves to inhibit the feeding of two sheets of paper from the paper stack. Gravity tends to hold the sheets of paper back against the posts 192 and 194 shown in FIG. 3. The guide arms 145 and 151, the brackets or channels 161 and 162 and the meshing gears 204 and 206 will constrain the paper support plate 158 to move not quite parallel to itself in its upward and downward travel, as in the embodiment of FIGS. 3 and 4. The departure from parallel motion comes from the fact that the angle guide arm 145 makes with the vertical is slightly less than the angle guide arm 151 makes with the vertical. The motion of the paper support plate, however, is almost parallel to itself. The departure from parallelism is a function of the sine of the angle that arm 145 makes with arm 151.

I provide my magazine and feeder with a paper length-adjusting member 172 having a portion extending in the direction of the length of the magazine 110, which portion is formed with an elongated slot 174. Slot 174 received respective guide pins 176 and 178 mounted on base portion 118 in spaced relationship. Retaining washers 180 on the pins 176 and 178 hold member 172 in place while permitting it to be shifted in the direction of its length with reference to the assembly. I provide the member 172 with indicia 182 at points along the length of the member corresponding to various lengths of paper. A pointer 184 carried by the post 176 may be aligned with the indicia to indicate the length of paper for which the apparatus is set. If desired, the indicia might be recessed to permit a detent (not shown) accurately to locate the member 172. A bracket 186 secured to member 172 extends outwardly through a slot 189 in wall frame 116 to receive a handle 188 by means of which the member 172 can be shifted.

A transversely extending arm 190 on member 172 carries a pair of spaced vertically extending posts 192 and 194 which locate the right-hand or rearward edge of the stack of sheets, such as paper, in the apparatus. I so shape the plate 158 and provide the auxiliary plate 166 with spaced slots 196 and 198 to permit the posts 192 and 194 to move to the left as an adjustment is made for sheets which are shorter than the longest sheets which can be accommodated by the magazine.

I mount respective pairs of paper edge guides 200 on the walls 112 and 116 so as to extend vertically at spaced locations on each wall.

From the structure thus far described, it will readily be apparent that the feed springs 134, 136, 138, and 140 normally urge plate 158 to move upwardly. As the plate moves upwardly, guide arm shafts 140 and 150 respectively move in a clockwise direction and in a counterclockwise direction as viewed in FIG. 4. Respective gears 204 and 206 on shafts 140 and 150 tie the guide arms together for rotation in opposite directions. If the guide arms form equal angles with the vertical, the plate will move upward and downward parallel to itself.

A pin 208 secures the hub 210 of a crank arm 212 to shaft 140 for movement therewith. I form the end of arm 212 remote from hub 210 with a gear segment 214 which meshes with a small servo-gear 216 carried by a shaft 218 for rotation therewith.

Shaft 218 also supports a flywheel assembly indicated generally by the reference character 220, formed by a hub 222, an outer plate 224, a generally annular weight 226, and an inner plate 228. It will readily be appreciated that the hub, outer hub, weight, and inner plate are assembled in any suitable manner known to the art. I position a one-way clutch 230 of the helical spring type between gear 216 and the flywheel assembly 220. Helical spring clutches such as clutch 230 are well known in the art. In the operation of clutch 230, when plate 158 is moving under the action of the driver springs 134, 136, 138, and 140 so that gear 216 tends to be driven in a counterclockwise direction as viewed in FIG. 4, clutch 230 clutches the flywheel 220 to the gear 216. More specifically, one end of the spring of the clutch is secured to the flywheel hub 222 and the clutch is so arranged as to tend to coil itself around the hub of gear 216 in a counterclockwise direction as viewed in FIG. 4. Thus, when the gear is driven in the same direction as that in which the spring tends to coil itself, the clutching action takes place. Conversely, when the small servo-gear 216 is driven in a clockwise direction, as the plate 158 is pressed downwardly during loading, the direction of movement of the gear is opposite to the direction in which the clutch spring tends to coil itself. This movement uncoils the spring and permits the flywheel to remain stationary so that the plate can easily be moved donwardly without utilizing the inertia of the flywheel.

It will readily be appreciated that the action thus described prevents injury to the operator of the machine when plate 158 is free to move up under the action of the drive springs. That is to say, if no inertial damper such as is provided by flywheel 220 were present, the force with which the springs move the plate 158 up is so great that the parts would be accelerated to move at an unsafe velocity.

I secure the hub 234 of a large servo-gear 232 on shaft 218 for rotation therewith. Gear 232 meshes with a brake gear 236, coupled by a one-way helical spring brake 238 to a pin 240 on wall frame 116. More particularly, the hub of gear 236 is rotatably supported on pin 240. One end of the spring 238 is secured to pin 240. The spring surrounds the hub of gear 236 and tends to coil itself around the hub in a clockwise direction as viewed in FIG. 4. When gear 232 tends to move gear 236 clockwise as viewed in FIG. 4, the helical brake spring 238 wraps itself around the hub of the gear to lock it to the pin 240. Thus, under normal conditions, plate 158 is prevented from moving up by the action of the brake assembly 238.

The action of brake 238 can be inhibited by moving the free end of the helical spring in a direction which tends to unwind the spring from the hub of the gear 236. An arm 242 freely supported on the shaft which carries gear 236 supports a pin 244, one end of which extends outwardly to a location to enable it to engage the free end of spring 238. The other and enlarged end of pin 244 extends inwardly through an opening in wall 116 to a position at which it can be actuated in a manner, as will be described hereinafter, to release the brake spring 238.

My magazine and feeder includes a lower paper exit guide 246, the edges of which are formed with respective brackets 248 and 250 spaced upwardly from the upper surface of the lower guide 246. The assembly includes an upper guide 252 and respective pivot arms 254 and 256, each of which is formed with a laterally extending tongue 258. Any suitable means such as screws 260 or the like secure the edges of the upper guide and the tongues 258 of the pivot arms 254 and 256 to the brackets 248 and 250 to form an assembly which guides a sheet of paper being fed out of the magazine inwardly and generally upwardly with respect to the copying machine 10 in a manner to be described. Respective pivot pins 262 and 264 in walls 116 and 112 receive the upper ends of the pivot arms 254 and 256 swingably to support the paper exit guide assembly on the walls.

I form the central portion of the upper paper guide with a bent portion 266 extending generally horizontally. I employ any appropriate means such as screws or the like to secure a paper feed bracket 268 having spaced uprights 270 and 272 to the portion 266 of the upper guide 252. Uprights 270 and 272 rotatably support the paper feed shaft 274.

I form the base of a power takeoff bracket 276 with a pair of slots 278 which receive screws 280 for adjustably mounting the bracket 276 on the upper guide 252. Bracket 276 rotatably supports a shaft 282 carrying a sleeve 284. Shaft 282 carries for rotation therewith a power takeoff gear 286 adapted to mesh with a split gear to be described more fully hereinbelow, which split gear is secured to the shaft 101 which carries paper feed roller 102 of the machine 10 for rotation therewith. Shaft 282 also carries for rotation therewith a drive pulley 288 which drives a belt 290 which engages a paper feed pulley 292 on an idler pin 294 carried by upright 272. Upright 272 also carries a pin supporting a belt roller 296. A gear 298 which rotates with pulley 296 engages a gear 300 secured to the paper feed shaft 274 for rotation therewith. Shaft 274 also carries a paper feed drive pulley 302 and a spacer 304 which cooperates with a paper feed guide arm 316 supported on the shaft to locate the gear 300 and the drive pulley 302 along the shaft. A paper feed pivot arm 306 carries a bearing housing 308 which receives a bearing 310 for rotatably supporting a drive roll shaft 312. A second guide arm 314 is pivoted about shaft 274 in spaced relation to arm 316 to cooperate with arm 306 to support shaft 312. The ends of shaft 312, extending beyond guide arms 314 and 316 in the direction of side walls 116 and 112, carry respective drive rollers 320 and 318 for rotation therewith. A belt 324 driven by pulley 302 drives a pulley 322 carried by shaft 312. Arm 306 also carries a belt idler roller 326. A traverse rod 328, which may act as a handle, passes through arm 306 and moves up and down with it. A stop pin 330 in wall 112 limits downward movement of the traverse rod 328. The other end of the rod 328 as viewed in FIG. 3 is adapted to strike the inner end of pin 244 upon a predetermined movement downward of the rod 328 to release the brake spring 238. The paper supporting plate will then move upwardly, lifting the feeding rollers 318 and 320. This lifts the traverse rod 328 out of engagement with the inner end of pin 244, thus permitting the clutch brake again to immobilize the gear 236 and hence the gear segment 212 to lock the shaft 140 against rotation. It will be seen I have provided a mechanical servomechanism. The feeding rollers sense the position of the top sheets of the stack of sheets. When one or more of these are fed, the feeding rollers drop sufficiently far to carry the feedback rod 328 downward to engage the pin 244 to release the brake 238. As soon as the feeding rollers move upwardly to lift the feedback rod away from pin 244, the upward movement of the stack of sheets stops.

I provide my magazine with a locating bracket 334 having a pair of side arms 336 and 338 and a pair of spaced tongues 340 and 342 at the left edge thereof as viewed in FIGS. 3 and 4. My assembly also includes a pair of magazine bracing brackets 344 and 346. The cassette locating bracket side arms 336 and 338 and the bracing brackets 344 and 346 are secured to the sides 116 and 112 by any suitable means, such as screws, rivets, or the like 348.

While one of the objects of my invention is to provide a large capacity cassette for use with an existing copy machine, it will be understood by those skilled in the art that my cassette is adapted to be used as a permanent, though removable, magazine for any copy machine. In order to conveniently adapt my large capacity cassette to an existing machine, the power required to feed sheets from my cassette to the existing machine must be obtained from the machine with which it is to be used.

Referring now to FIG. 8, in order to take power from shaft 101, which is driven by energy from the prime mover of the copy machine with which my cassette is to be used, I provide a pair of split gear halves 350 and 352 adapted to be assembled on the shaft and to be held thereon by a collet 354 adapted to be slipped over the hub halves of the gear halves 350 and 352. A set screw 356 secures this assembly in position. I provide a locating gauge 360 which cooperates with a snap ring 358 on an existing machine accurately to locate the gear halves 350 and 352 along the shaft of roller 102. It is to be noted that I form the teeth of gear halves 350 and 352 and the teeth of gear 286 with triangular profiles so that the gears will accurately mate when brought into engaging relationship.

Figure 5:
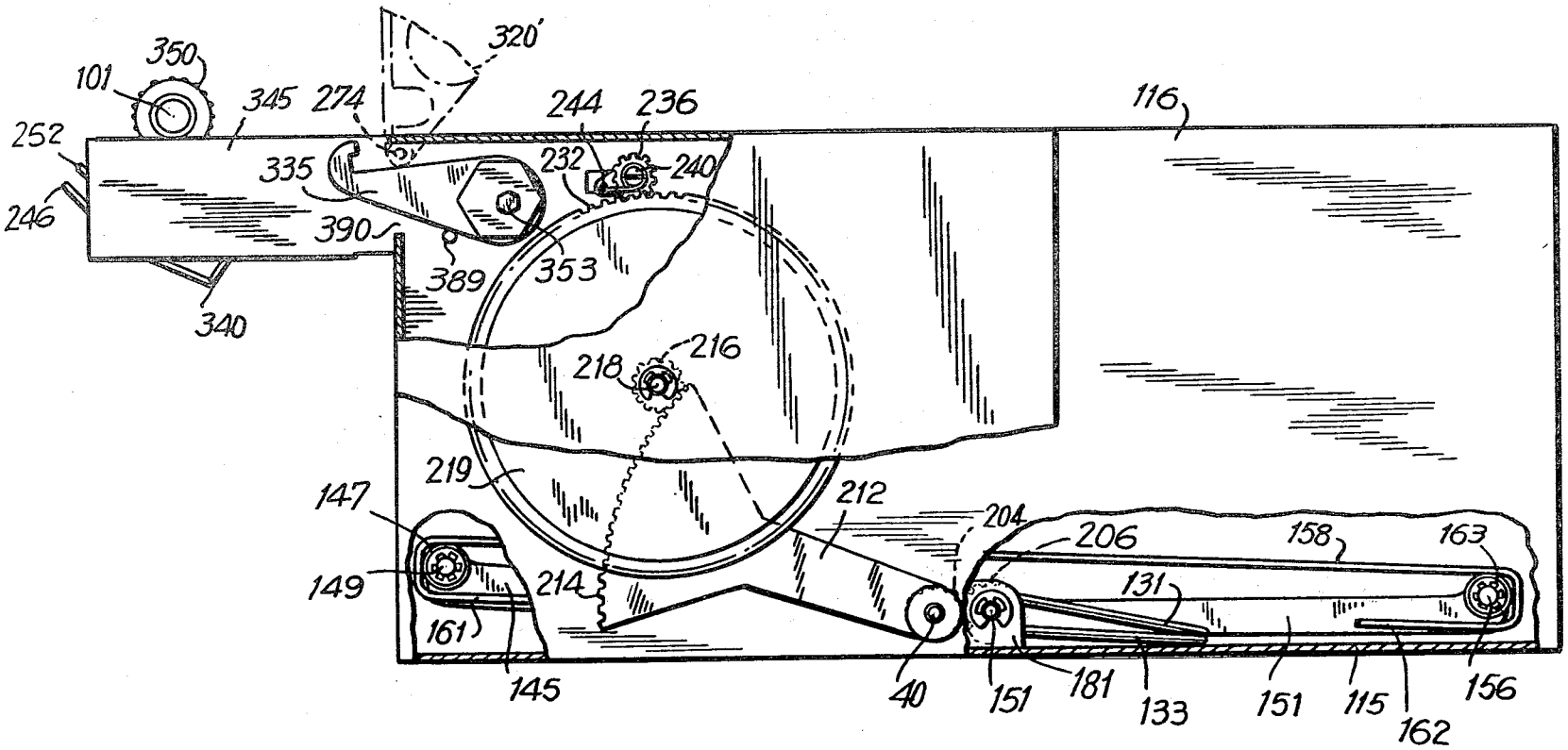
FIG. 5 is a fragmentary sectional view of a copying machine provided with my large capacity combination magazine and sheet feeder illustrating the manner in which the magazine and sheet feeder is supported on the machine.

Referring now to FIG. 5, the machine 10 of the type shown in the Suzuki et al patent includes an upper cassette 362 having a base opening 364 and a paper stack support plate 366. The underside of the cassette 362 is formed with a pair of projections 368 which ride behind spring loaded rollers 370 when the cassette is inserted into the opening adjacent to feed roller 100.

An upper paper feed enabling shaft 372 carries a pair of arms 374 which rotatably support rollers 376. A lower paper feed actuating shaft 378 carries arms 380 which support rollers 382. An arrangement is provided for selectively rotating one of the shafts 372 and 378 to active position while the other shaft is in inactive position. In the active position of its shaft, the associated rollers 376 or 382 are moved upwardly. In the case of the upper cassette 362, movement of the arm engages rollers 376 with the underside of plate 366 resiliently to urge the stack of sheets 98 into engagement with the roller 100. Conversely, when shaft 378 is moved to the active position, its associated rollers 382 engage the underside of the lower paper guide 246 to swing gear 286 into engagement with the gear made up of the two halves 350 and 352.

Referring to FIG. 6, the mechanism for selectively moving rollers 376 or rollers 382 to operative position includes a bell-crank lever 384 supported on a pivot pin 386 on the machine frame. A handle 388 accessible from outside the machine 10 permits the lever 384 to be moved between its two positions to be described. A lever positioning arm 390 pivotally supported on a pin 392 on the machine frame carries a cam 394 which is adapted to cooperate with a cam-follower 396 on one arm of the bell-crank lever 384. A spring 398 connected between the pivot pin 386 and the end of arm 390 remote from pivot pin 392 urges the upper edge of the arm 390 into engagement with cam-follower 396.

In the position shown in full lines in FIG. 6, spring 398 holds the lever 384 in its lower position. The handle 388 may be operated to move the lever 384 upwardly to its broken-line position in the course of which movement cam-follower 396 rides over cam 394. In this position of the parts, the handle 384 is releasably held in its upper position.

A bell crank 400 is carried by the lower shaft 378 for rotation therewith. A spring 402 connected between one arm of bell crank 400 and the machine frame normally urges the bell crank to the full-line position shown, at which a pin 404 on the other arm of the bell crank engages an arm of lever 384. This is the active position of shaft 378 in which spring 402 has moved it to a position at which rollers 382 are resiliently urged into engagement with the lower paper chute guide 246. At the same time, the lower edge of handle 384 acts on a pin 410 carried by an arm 406 supported on shaft 372 for rotation therewith to move the arm 406 against the action of a spring 408 extending between pin 410 and the machine frame to a position at which the upper rollers 376 are in inoperative position. Under these conditions, when rollers 100 and 102 rotate, only the lower roller shaft is effective to cause a sheet of paper to be fed from my magazine 110.

Referring again to FIG. 5, the underside of the machine frame is formed with a reinforcing channel 412. In order to assemble my magazine on the machine 10, the handle 388 is moved to its upper position so that rollers 382 are in their inactive positions. Next, the arms 336 and 338 of the bracket 334 are inserted in the lower cassette opening of the machine and the braces 344 and 346 extend to positions at which their ends underlie the reinforcing channel 412. At the same time, each of the tongues 340 and 342 rides over a spring-loaded roller 370 (shown in FIG. 7) so as properly to locate my magazine on the copy machine 10.

Referring again to FIGS. 3 and 4, arms 254 and 256, supported on pins 262 and 264 on the frame, swingably support guides 246 and 252 for movement relative to the frame. Guide 252 supports bracket 268, which carries shaft 274, which pivotally supports bracket 306, which supports the bearing 310 of shaft 312. This shaft supports rod 328. A cover 414 is provided with three dependent lugs 416, 418, and 420. Lug 416 is centrally located, while lug 418 is positioned adjacent side frame 116 and lug 420 is positioned adjacent side frame 112. The rod 328 passes through lugs 418 and 420 with sufficient play to move up and down. When cover 414 is swung to the broken-line position 320′ shown in FIG. 4, rod 328 and rollers 318 and 320, carried by shaft 312, swing together with the cover 414 around the axis of shaft 274. When the cover is in open position, the brake 238 is set.

As has been described above, in the operative position of the magazine and sheet feeder, rollers 382 act on the underside of guide 346. In this position, the assembly of guides 252 and 246 are swung to a position to enable rollers 318 and 320 to engage the uppermost sheet of the stack in the magazine. A spring 422 biases the rollers 318 and 320 into this engagement with a pressure of approximately 300 grams.

My apparatus also includes a back cover 424 pivoted about a shaft 425, a servomechanism cover 426 secured to side frame 116 by any suitable means, and side covers 428.

In operation, where my high capacity combination magazine and sheet feeder is to be used with an existing copying machine, such for example as that shown in the Suzuki et al patent referred to hereinabove, I first assemble the split gear halves 350 and 352 and the collet 354 on the shaft 101 in the manner heretofore described. Next, my high capacity combined magazine and sheet feeder is assembled in position to replace the lower of the two cassettes of the Suzuki et al patent. This is achieved by first moving lever 388 to the dot-dash line position shown in FIG. 6, assembling the cassette 110 in position, and then moving the lever 388 back to the full-line position shown in FIG. 6. In this relative position of the parts, the split gear comprising halves 350 and 352 is brought into operative engagement with the gear 286.

It will readily be appreciated that my large capacity combination magazine and sheet feeder is adapted to be used independently of the machine shown in the Suzuki et al patent. That is to say, in a machine of another design, the rollers 318 and 320 could be made an integral part of the feed mechanism, with the remainder of the magazine structure being removable from the machine with which it is used. In such an arrangement, when the magazine is assembled on the machine, the feed rollers 318 and 320 would automatically be brought into engagement with the uppermost sheet in the magazine. Furthermore, my magazine may be furnished as original equipment for a copy machine.

Considering the arrangement in which my magazine is used with an existing machine, after it has been assembled thereon in the manner described hereinabove, in the loading of the magazine with sheets, the cover 414, the rollers 318 and 320, the feed-back actuating rod 328, and the idler 326 are pivoted around the axis of shaft 274 to the position 320′ illustrated in dot-dash lines in FIG.

4. Next, the rear cover 424 is pivoted around its shaft 425 to a position at which the interior of the magazine is accessible. When this has been done, the magazine may be loaded by placing any desired number of sheets, up to the full capacity of the magazine, on the plate 166 which is carried by the main support plate 158. The sheets and the plates may then be pushed downwardly to any intermediate position or to the bottom limit position. In either case, the brake 238 which is set ensures that the assembly will not move upwardly under the action of the relatively heavy driver springs. While the capacity of the magazine is limited by the structural frame of the machine to which it is attached, I have built a magazine which has a capacity of 1000 sheets and operated it successfully with a machine such as is shown in Suzuki et al U.S. Pat. No. 3,977,666. If desired, one can move the stack support plates to any position with or without sheets thereon, in which position the assembly will be held by the action of the one-way clutch spring 238 which acts as a brake in one direction while permitting movement in the other. It will thus readily be appreciated that there is no danger to the operator of the paper support plate snapping back. Even if the one-way clutch or brake spring 238 were released, the plate assembly would move upwardly against the inertial damping provided by the assembly 220. Thus, in no event can the paper support fly rapidly upwardly.

After the magazine has been loaded, the rear cover 424 is moved to its closed position, and the front cover 414 is moved to its closed position shown in FIG. 4. The rod 238 will be in its down limit position and release the brake 238. The stack of paper will move up until the feed rolls 318 and 320 are thus restored to their paper-feeding position and are in engagement with the uppermost sheet in the stack of sheets. A spring 422 gently biases the rollers into engagement with the top sheet. When a copying operation takes place, the uppermost sheet in the stack is driven through a distance sufficient to move its leading edge into the nip between the synchronizing rollers 94 and 96 of the copy machine. Where the roller 102 is used with a cassette of the type shown in the Suzuki et al patent, it rotates through a sufficient distance to move the sheet engaged thereby into the nip between the synchronizing rollers 94 and 96. In my arrangement, since my rollers 318 and 320 are a greater distance from the synchronizing rollers 94 and 96 than is the roller 102, I must drive the sheet through a greater distance. I so arrange my system as to produce a sufficient rotation of rollers 318 and 320 in response to the normal rotation of roller 102 as to ensure that the leading edge of the sheet being fed arrives at the nip between the rollers 94 and 96. It is to be noted, moreover, that I achieve this result with the shortest paper which is to be handled by the cassette.

Following this initial feeding of the sheet, the operation of the copy machine is as before. In response to rotary movement of drum 16 through a distance, such that a sheet fed by rollers 94 and 96 will register with the leading edge of the image on the sheet, the roller drive is energized to feed the sheet to the drum, the image is transferred thereto, and the sheet is carried away from the machine.

My mechanical servomechanism ensures the uppermost sheets of the stack are always in feeding position. The servomechanism is such that it will have amplitude of freedom. That is, it is not necessary that the stack be moved after a single sheet or several sheets are fed. The feeding rollers are biased into engagement with the stack of sheets. As the shaft carrying the feed rollers moves downwardly, the feed-back rod also moves in a direction to release the brake which prevents the paper stack supporting plate from moving upwardly. It will be understood that I can make my mechanical servo-system as sensitive as necessary by narrowing the tolerances and spacing of its components.

It will be seen that I have accomplished the objects of my invention. I have provided a large capacity combination magazine and sheet feeder which is interchangeable with cassettes of copy machines of the prior art. My apparatus receives all of its logic and power from the paper feed shaft of an existing copy machine. My magazine and sheet feeder requires no external energy source for maintaining the correct height of the upper sheets in the paper stack. The level of the upper sheets in the stack of my magazine and sheet feeder is controlled by the paper feed rollers which initiate the raising of the stack of sheets. My magazine can be loaded without danger to the operator. My large capacity combination magazine and sheet feeder is relatively inexpensive to construct and certain in its operation.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a magazine and automatic sheet feeder for successively delivering sheets from a delivery end of said magazine in which the improvement comprises biasing means for raising said stack with its top sheets adjacent said discharge end, a one-way clutch brake for restraining said stack against upward movement when the top sheets are at a predetermined location adjacent to said discharge end, a feed foller, means mounting said feed roller on said magazine for swinging movement into engagement with the top sheet, means responsive to movement of said roller after a sheet is fed from said magazine for releasing said brake, an inertial damper, and a one-way clutch coupling said inertial damper to said stack to limit the rate of upward movement of said stack.

2. A manually detachably mounted sheet feeder for a copying machine having a feed roller shaft including in combination, a frame forming a magazine for holding a stack of sheets, a delivery roller, means mounting said delivery roller on said frame in engagement with the top sheet of said stack, manually operable means for detachably mounting said frame in a fixed position on said machine, and means including interengageable gears respectively carried by said feed roller shaft and by said frame adapted to engage upon the mounting of said frame on said machine to provide a driving connection between said feed roller shaft on said machine and said delivery roller on said frame, said gear on said feed roller shaft being a split gear, and means for detachably mounting said split gear on said feed roller shaft.

3. A manually detachably mounted high capacity magazine and sheet feeder for replacing the normal magazine of a copying machine having a pair of synchronizing rollers and a normal magazine paper pickoff roller shaft at a certain distance along a paper feed path from said synchronizing rollers at which it is adapted to engage the top sheet in a normal magazine and driven through a normal rotation sufficient to advance said top sheet from said normal magazine to said synchronizing rollers, including in combination a frame forming said high capacity magazine for holding a stack of sheets, a high capacity magazine paper pickoff roller, means mounting said high capacity magazine paper pickoff roller on said frame in engagement with the top sheet in said stack, said high capacity magazine paper pickoff roller being located at a position along a paper feed path further from said synchronizing rollers than is said feed roller shaft, manually operable means for detachably mounting said frame in a fixed position on said machine, and means including interengageable elements respectively carried by said normal magazine paper pickoff roller shaft and by said frame adapted to engage upon the mounting of said frame on said machine to provide a driving connection between said normal magazine paper pickoff roller shaft on said machine and said high capacity magazine paper pickoff roller on said frame, said last-named means including a drive train responsive to said normal rotation of said normal magazine paper pickoff roller shaft for driving said high capacity paper pickoff roller through a rotation sufficient to move a sheet from said high capacity magazine to said synchronizing rollers.

* * * * *